US006077150A

United States Patent [19]

Jankowski

[11] Patent Number: 6,077,150

[45] Date of Patent: Jun. 20, 2000

[54] PROFILING METHODS FOR GENERATION OF MODIFIED GRINDING WORMS

[75] Inventor: Ralf Jankowski, Bad Säckingen, Germany

[73] Assignee: Reishauer AG, Wallisellen, Germany

[21] Appl. No.: 09/020,898

[22] Filed: Feb. 9, 1998

[30] Foreign Application Priority Data

Feb. 21, 1997 [DE] Germany ..... 197 06 867

[51] Int. Cl.[7] ..... B24B 1/00

[52] U.S. Cl. ..... 451/47; 451/48; 451/147

[58] Field of Search ..... 451/47, 409, 66, 451/48, 147

[56] References Cited

U.S. PATENT DOCUMENTS

| | | | |
|---|---|---|---|
| 4,475,319 | 10/1984 | Wirz | 451/5 |
| 4,860,501 | 8/1989 | Belthle | 451/48 |
| 4,998,385 | 3/1991 | Umezono et al. | 52/563 |
| 5,129,188 | 7/1992 | Alverio | 451/48 |
| 5,325,634 | 7/1994 | Kobayashi et al. | 451/253 |

FOREIGN PATENT DOCUMENTS 3704607 8/1988 Germany .

WO 95/24989 9/1995 WIPO .

*Primary Examiner*—Timothy V. Eley

*Attorney, Agent, or Firm*—Sughrue, Mion, Zinn, Macpeak & Seas, PLLC

[57] ABSTRACT

Method and an apparatus for the profiling of single-gear or multiple-gear grinding worms for grinding tooth profiles in accordance with the principle of continuous diagonal hob grinding. A grinding worm is divided into at least two axial segments wherein one segment remains unmodified and a second segment receives, by means of special profiling methods, modifications of the spiral faces for the generation of tooth face modifications. The main attribute of these profiling methods is additional movements, which are superimposed on the disk-shaped profiling tool and/or the grinding worm in relation to a given profiling lift position, and which result in the modifications of the grinding worm faces that are mapped onto the faces of the toothed wheel work during subsequent diagonal hob grinding across a grinding worm segment profiled in this manner. Additional movements designed to generate the modifications include, in particular, pivoting of the profiling tool around an axis (F) or pivoting the grinding worm around an axis (C) during profile dressing, as well as continuous incline change during line-by-line profiling.

5 Claims, 8 Drawing Sheets

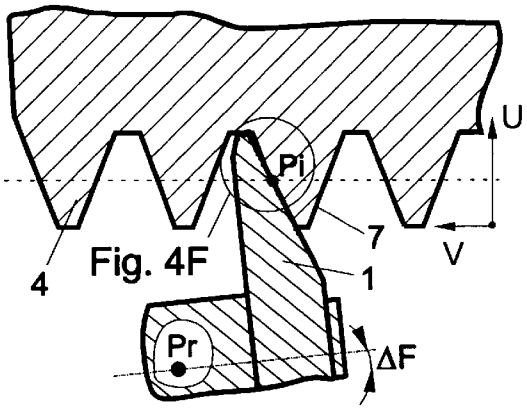
Fig. 4E
Fig. 4F
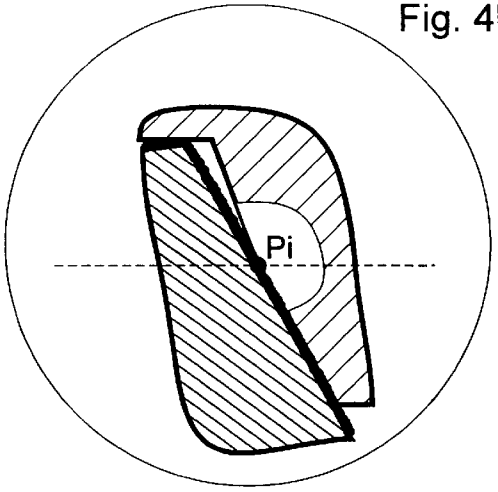
Fig. 4F
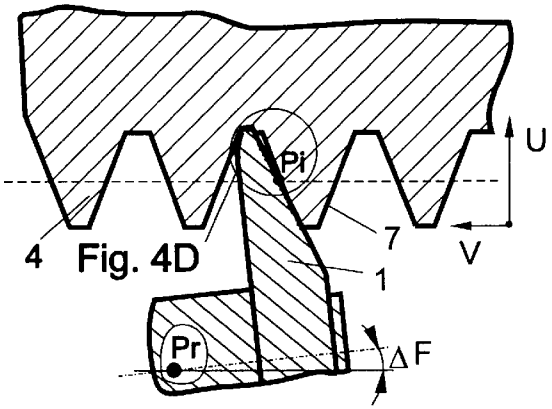
Fig. 4C
Fig. 4D
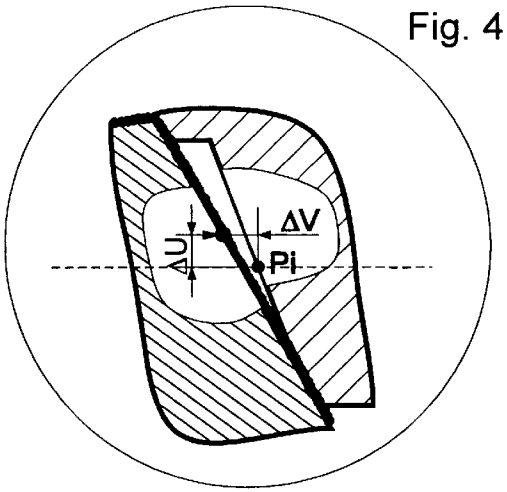
Fig. 4D
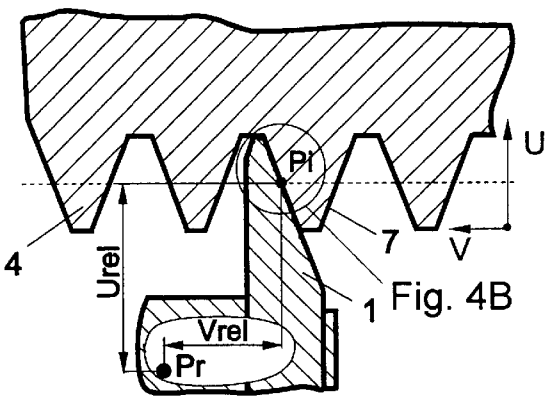
Fig. 4A
Fig. 4B
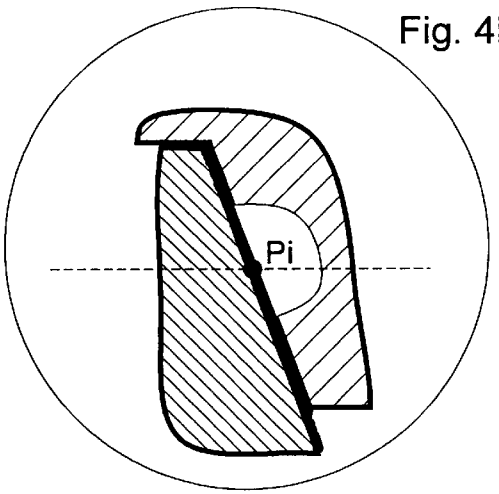
Fig. 4B

PROFILING METHODS FOR GENERATION OF MODIFIED GRINDING WORMS

BACKGROUND OF THE INVENTION

This invention relates to methods and an apparatus for the generation of a single-gear or multiple-gear grinding worm for grinding tooth profiles in accordance with the principle of continuous diagonal hob grinding.

The majority of the spur wheels used in gear technology today have involute tooth profiles. However, for power reasons the gearing of two involute toothed wheels often fails to produce an optimal operating response. Consequently, the tooth profiles are modified, divergent from the involute, by means of design calculations in the direction of both the depth and the width of the tooth. As the extent of such modifications generally falls within the micrometer range, grinding processes play a critical role in the generation of modified tooth profiles.

The more straightforward modifications of tooth profiles consist primarily of depth or width crowning, crown or root relief machining in relation to tooth depth, as well as end relief machining in relation to tooth width. If we view these modifications in terms of their change response in the two directions on a tooth profile (tooth depth and tooth width), we can see that they are tooth profile modifications that always change in only one tooth profile direction at a time, while remaining constant in the second tooth profile direction. During continuous hob grinding, these modifications can be achieved either by means of profiling of the grinding tool with special profiling tools (generally modifications in the direction of tooth depth) or by means of appropriate movement of the machine axes (generally modifications in the direction of tooth width). In the latter case, these additional axial movements during continuous hob grinding often result in unwanted distortion of the tooth face profile.

In contrast, the generation of complicated tooth face modifications is associated with various requirements in several face cuts and/or several cylinders. In extreme cases, each point on the face of the tooth may consist of a specific modification value (difference between the profile shape and the involute). The generation of this type of toothed wheel work by means of continuous hob grinding requires special technological procedures.

The technical status during the profiling of grinding worms remains an important factor in arriving at a solution. Referring to FIG. 1, a disk-shaped profiling tool 1 is often used in these types of procedures. This profiling tool is shifted in relation to a rotating grinding worm 2 by means of a lifting motion 3 in which the profiling tool touches the crown, the face and/or the root of one or both faces of the spiral 4. The lifting motion of the profiling tool and the rotational movement 5 of the grinding worm 2 are precisely attuned to one another, so that the profiling tool completes a path defined as P1 * module * number of starts within a single revolution of the worm. Of the multitude of procedural specifications applied in this regard, two general principles are known.

During profiling of the profile roll (FIG. 1*a*), the active section 6 of the disk-shaped profiling tool has a single-tapered or double-tapered profile. During the profiling procedure, this shape leads to a line contact between the profiling tool 1 and a normal section of the spiral 4. The advantage of these contact relationships is that the entire depth of the spiral (h), including the root and crown areas, can be profiled with a single lifting motion 3 of the profiling tool or of the grinding worm across the width of the grinding worm (b*s*). As an increasingly large section of the face depth of a spiral segment is engaged in this method (generally the entire profile), it will be referred to hereinafter as profile dressing.

Profiling with shaped rolls (FIG. 1*b*) involves the use of a disk-shaped profiling tool which may, for example, have a radius profile within the active section 6. In this tool, the contact between the profiling tool and the spiral is virtually punctiform. Thus, only a very limited section of the spiral depth (h) is profiled during each lifting motion 3 across the width of the grinding worm ($b_s$). A multitude of profiling strokes is needed to profile the entire spiral, with the profiling tool being advanced by a defined value ($\Delta U$) along the spiral depth after each stroke. This profiling method leads to lengthy profiling times, particularly in the case of grinding worms with large modules. However, it is also known that, because of the point contact within the range of contact, this method is very advantageous for the generation of virtually infinite modifications along the spiral depth. In the following text, this method will be referred to as line-by-line profiling.

In a known procedure for generating complicated tooth face modifications in a hob grinding process, the grinding tool is tangentially displaced in relation to the toothed wheel during one cutting stroke (shifting or diagonal grinding) (DE 3704607). A special feature of the hob grinding procedure is that, because of the tangential shift taking place during the cutting stroke, a new contact line between the toothed wheel and the grinding worm can be allocated to each toothed wheel normal cut. Through the use of a grinding worm that has a spiral with continually changing face contact angles across its entire active width, the aforementioned procedure compensates for procedure-related distortion of the tooth face. This distortion occurs during the continuous hob grinding of diagonally toothed spur wheels if the axial distance between the workpiece and the tool changes during the cutting stroke (e.g., during the generation of crownings). A disadvantage of this procedure is that the grinding worm receives modified pressure angles (modifications) along its entire active width. Consequently, when grinding worms are used with conventional grinding agents, there is increased wear in those worm sections in which grinding is characterized by greater time-cutting volume. In contrast, more flexible profiling of the spiral with new pressure angle changes (modifications) is not possible when using a combination of grinding worms that cannot be profiled and super-hard grinding agents.

In regard to line-by-line profiling, a procedure is known (WO 95/24989) in which a grinding worm is given various modifications in various width sections, beginning with the tooth face modifications to be generated. During application of line-by-line profiling of the grinding worm, these individual width sections are given modifications along the depth of the spiral which differ from section to section but remain constant within a given section. As a result, there are transitional sections between the individual width sections of the grinding worm in which a transition occurs between the spiral depth modification of one width section and of the spiral depth modification of the following width section. The generation of continuous face modifications in the direction of worm width and, consequently, in the direction of tooth face width, is not possible with this procedure.

SUMMARY OF THE INVENTION

Beginning with the known state of the art as described above, an object of this invention is to provide a grinding worm with a geometry and face topology which, on the one hand, allow for high time-cutting volume and, on the other hand, allow for the generation of tooth face modifications on the micrometer level. This task, in turn, produces a need to develop methods or a combination of methods which allow for flexible profiling of grinding worms with modified spiral faces. In doing so, we must also decide which modifications of the faces of a spiral can be generated with which profiling method or with which combination of profiling methods, while making allowances for quality restrictions regarding the toothed wheel work being ground, as well as the goal of minimizing profiling time. Finally, an apparatus must be developed which can be used to execute the profiling procedure or combination of profiling procedures.

The solution to this task is based on the two known fundamental methods for profiling spirals, profile dressing and line-by-line dressing, as well as on the diagonal hob grinding of toothed wheel work.

BRIEF DESCRIPTION OF THE FIGURES

FIGS. 4*a* to 4*c* show a profiling method for generation of spiral face modifications by means of profile dressing.

DETAILED DESCRIPTION OF THE PREFERRED EMBODIMENTS

Figure 2A:
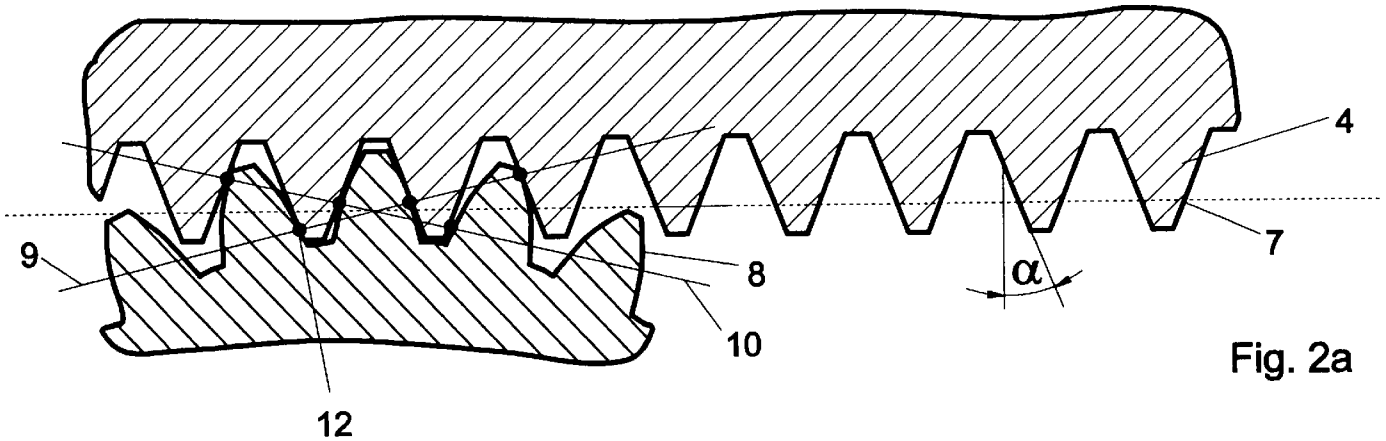
FIG. 2*a* shows the contact relationships during continuous hob grinding.
Figure 2B:
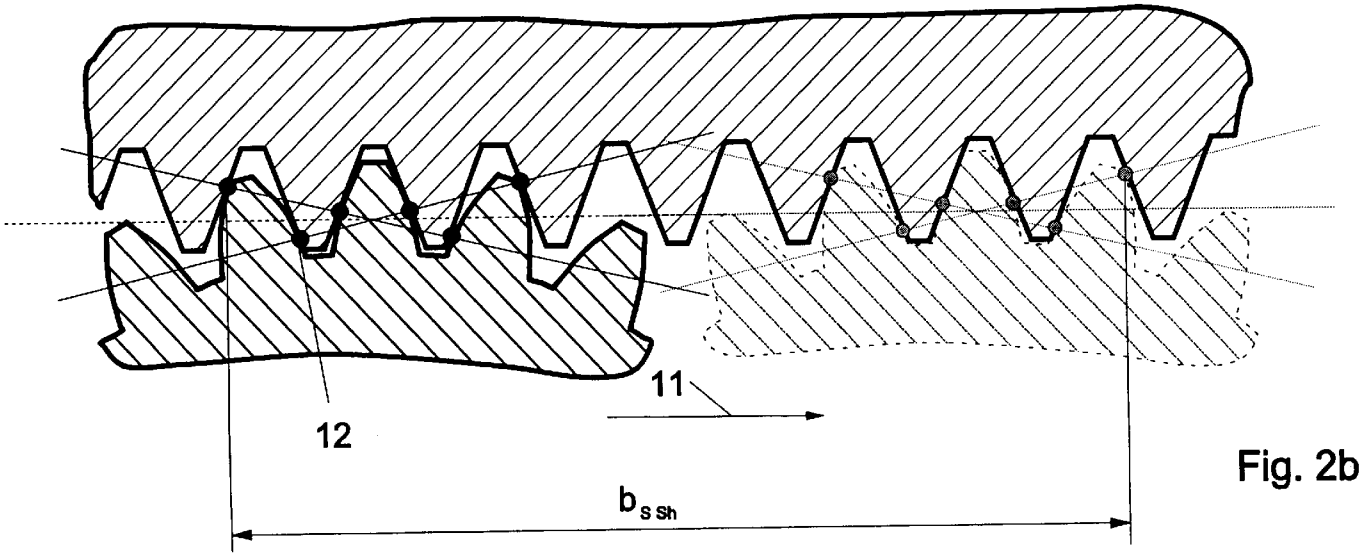
FIG. 2*b* shows the shift path during continuous diagonal hob grinding.

To generate involute tooth faces without modifications, a basic tool profile (reference profile) is used that consists of a toothed rack 4 with straight tooth faces 7, which are inclined against the profile line at a contact angle ($\alpha$) of the toothed wheel work, as shown in FIG. 2. If we make allowances for the contact lines that are established between the right faces 9 and left faces 10 (FIG. 2*a*) when the involute profile being generated 8 contacts the reference profile (toothed rack 4), as well as for the additional shift motion 11 (FIG. 2*b*) that occurs during hob grinding, we can obtain an adequate approximation, by means of a transformation calculation, for allocation of a contact point 12 on a corresponding normal section of the spiral (reference profile) to any point on the tooth face. Depending on the shift displacement and the width of toothing, we obtain, in the axial direction of the grinding worm, a shift section ($b_{ssh}$) that is passed over by the toothed wheel work during the cutting stroke. If this transformation calculation is performed for a network of tooth face points, modification values (plus/minus variance of the tooth face profile from the involute) for defined tooth face points can be allocated to specific contact points on the spiral face. Thus, we may obtain the reference profile modification values ($M_{i,j}$) (plus/minus variance of the spiral face profile from the involute reference profile) depicted in FIG. 3 across the spiral depth (h) of a normal section of a spiral in a defined grinding worm width position ($V_1$).

Thus, in this first step the desired modifications of a tooth face are transformed on the face of a spiral. It should be noted that, because of the mirror image principle, the preceding signs of the modifications are reversed during the transformation calculation. Points on the spiral face that do not come into contact with the tooth face are assigned a modification value of zero. The transformation calculation produces a reference profile for the faces of a modified spiral for any worm width position.

Figure 3A:
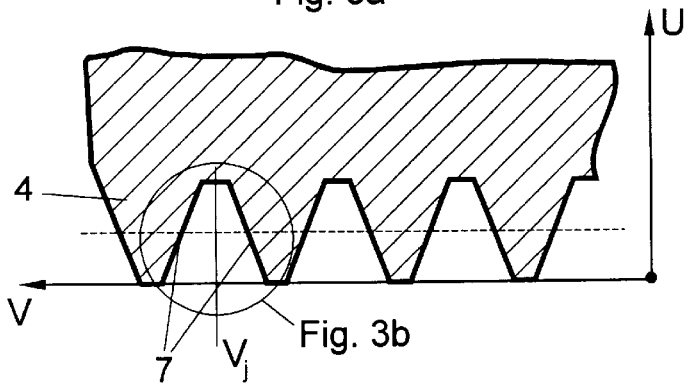
FIG. 3 shows modifications of the spiral face along the depth of the spiral for the normal cut of a spiral.
Figure 3B:
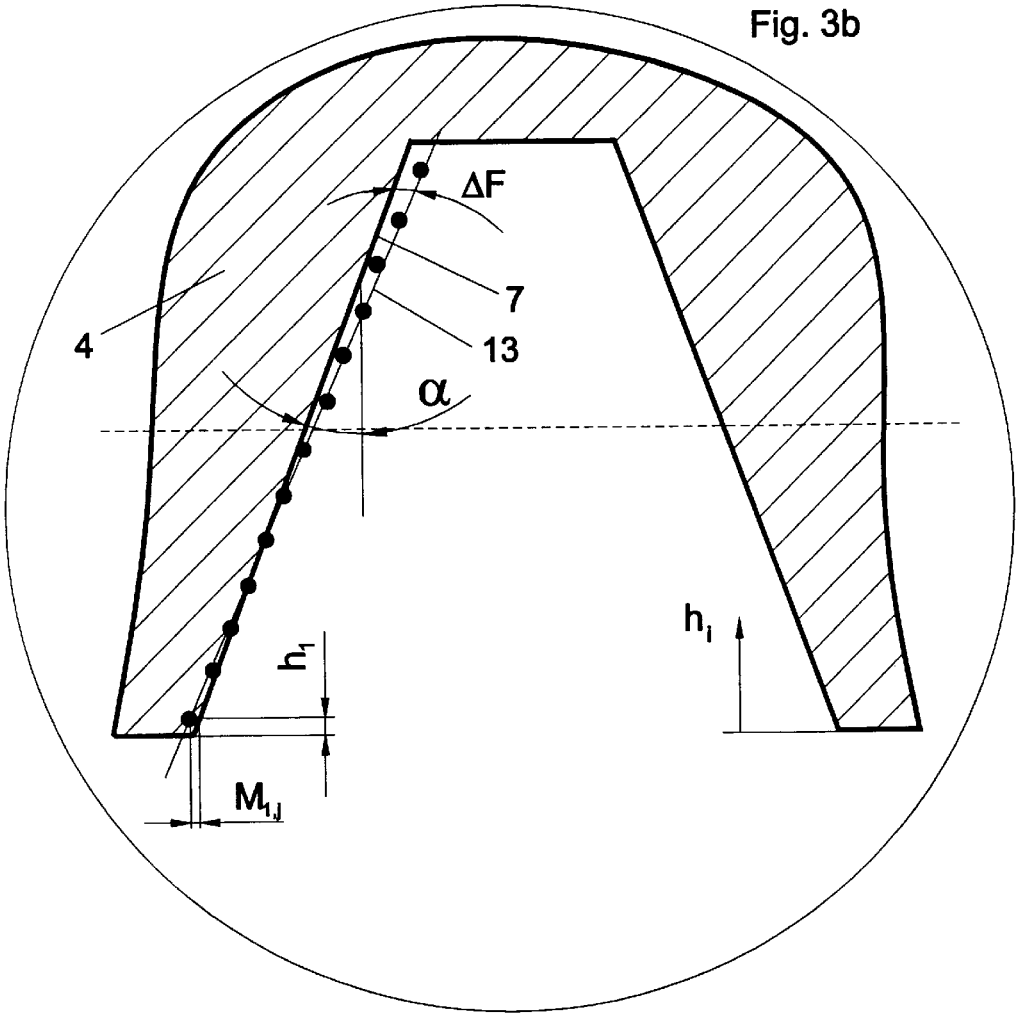

The time-effective generation (profiling) of the reference profile of the modified spiral faces is achieved by means of profile dressing and is initially due to the fact that a relationship is established between the modification values ($M_{i,j}$) and the spiral depth position ($h_i$) in a specific worm width position ($V_j$) by means of a correcting calculation for each of the two faces 7 of a normal section of the spiral (FIG. 3). Any constant functional approach can be used as the correcting function, although it should be noted that once an approach has been selected it must continue to be applied to calculations for additional normal sections of the spiral. If, for example, the linear function is selected as the correcting function, the calculated incline of the correcting straight line 13 represents an angle ($\Delta F$) by which the pressure angle of the modified reference profile differs from the pressure angle of the face of the unmodified reference profile in the corresponding grinding worm width position ($V_j$). If this correcting calculation, using the selected functional approach, is performed for a plurality of normal sections of the spiral across the width of the worm, we obtain a general relationship between the incline values and/or the angle ($\Delta F$) and the grinding worm width position ($V_j$).

Figure 1B:
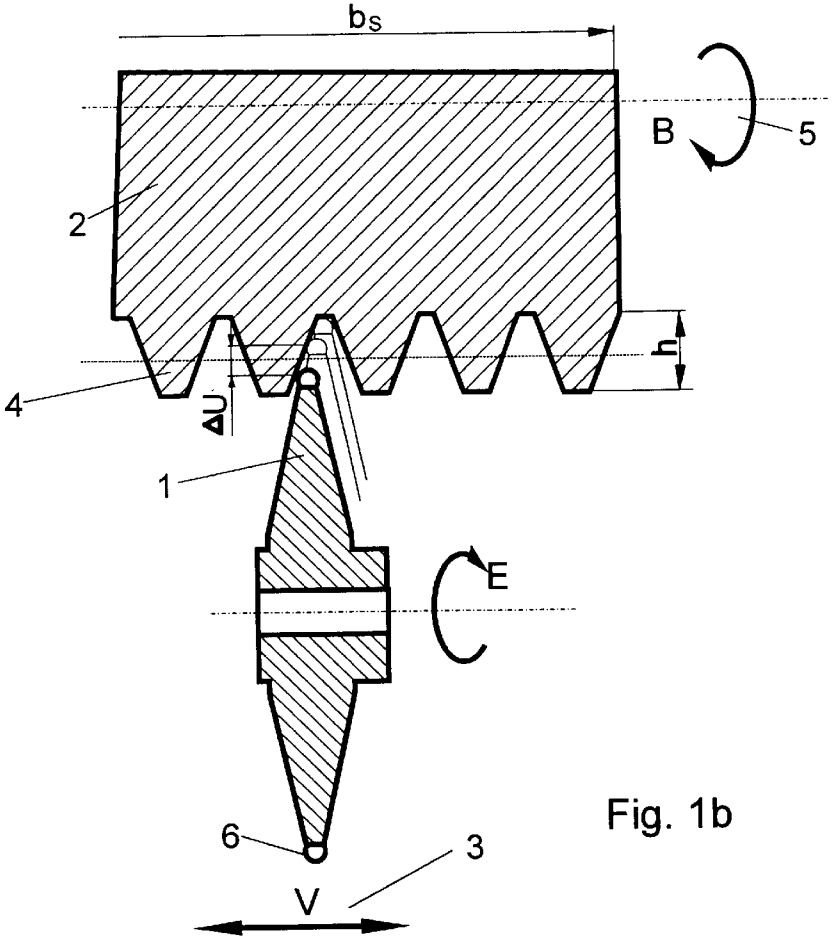
FIG. 1*b* illustrates the principle of line-by-line profiling of grinding worms.
Figure 1A:
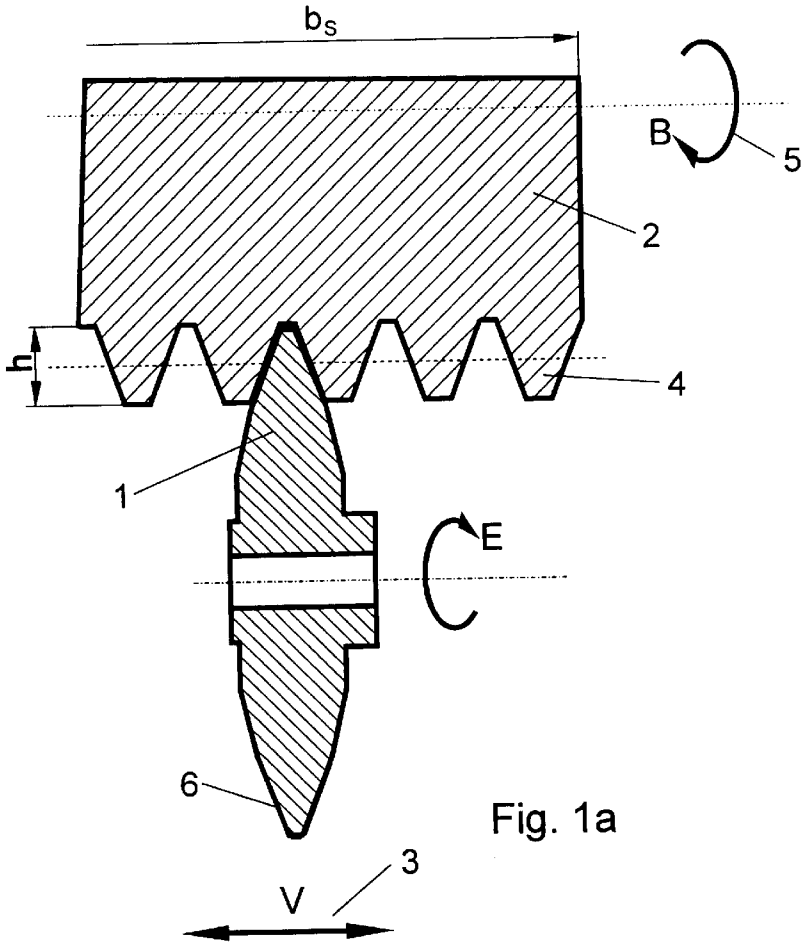
FIG. 1*a* illustrates the principle of profile dressing of grinding worms.

If, in view of the profile dressing (FIG. 1*a*), the face profile 6 (e.g., straight) of a profiling tool 1 embodies the selected correcting function, the sum of the incline values of the correcting functions forms a command variable for the constant pivoting of a profiling tool around a rotational axis (F) and across the width ($b_s$) of the grinding worm and/or the profiling stroke. If a rotational axis is not available for pivoting of the profiling tool, the same effect can be achieved by pivoting the grinding worm around a rotational axis (C).

In a second step, we obtain the following relationship in reference to the pivoting of the profiling tool:

$\Delta F = f(V)$, or in reference to the pivoting of a grinding worm:

$\Delta C = f(X)$.

It is evident in FIGS. 4*a* and 4*b* that, as a result of the pivoting motion around a rotational point ($P_1$) (rotational axis F), the face of the profiling tool 1 is brought out of the desired position with respect to its advance position (U axis) and stroke position (V axis) against the face 7 of the spiral 4. Consequently, the variances in position resulting from the pivoting motion of the profiling tool must be corrected by means of simultaneous correcting movements $\Delta U$ and $\Delta V$ (FIGS. 4*b* and 4*c*) in the directions U or V (for the profiling tool) and/or $\Delta X$ and $\Delta Y$ in the directions X and Y (for the grinding worm). The magnitude of these correcting movements is primarily dependent on the size of the pivoting angle $\Delta F$, as well as on the position of the real point of rotation ($P_r$) of the F axis in relation to the ideal point of rotation ($P_i$) on the face of the profiling tool during profiling. They can be calculated by means of the following relationships:

$\Delta V=f(\Delta F, U_{rel}, V_{rel})$, $\Delta U=f(\Delta F, U_{rel}, V_{rel})$.

Figure 5:
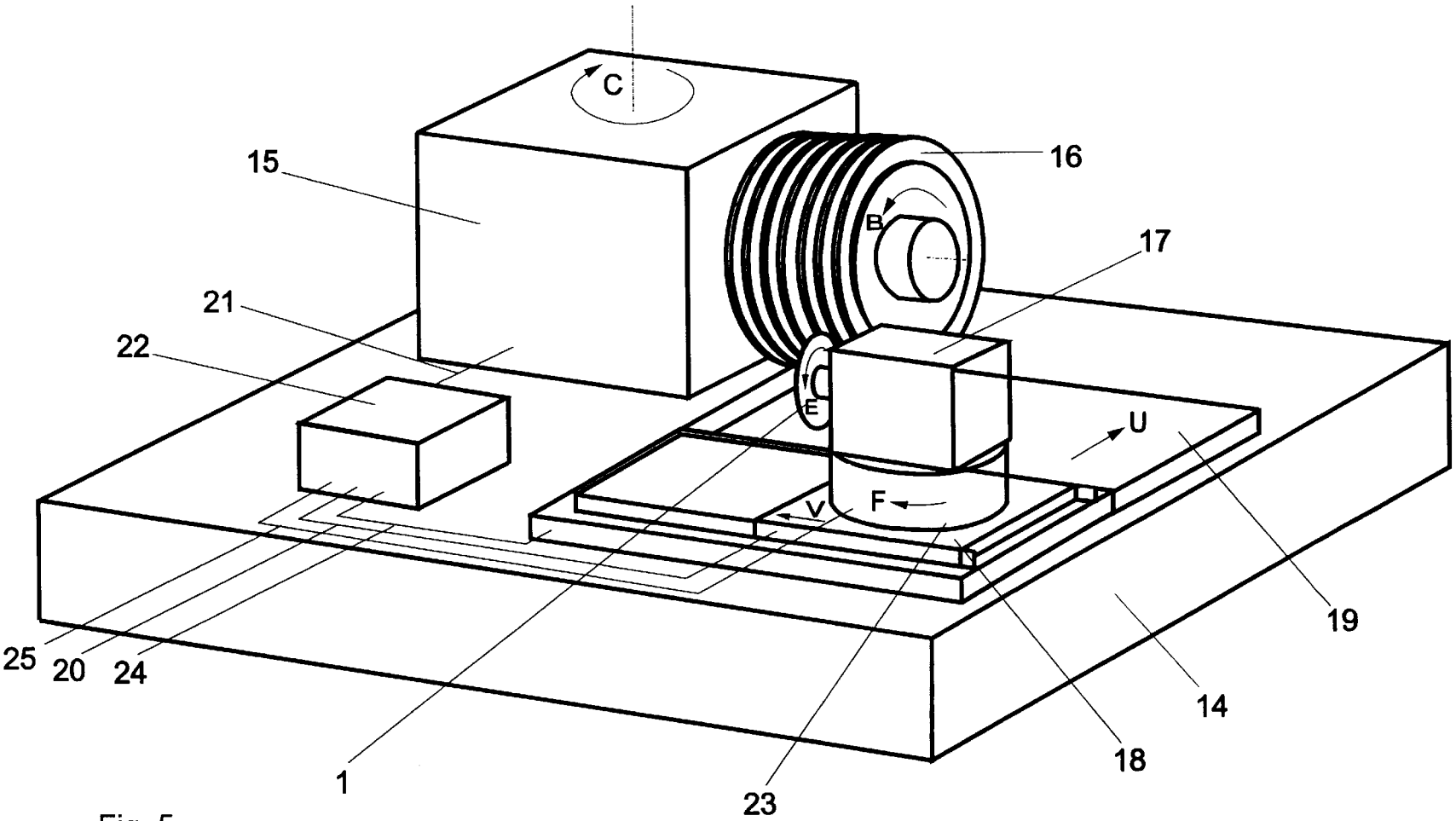
FIG. 5 shows a device for execution of the proposed profiling method.

Comparable conditions occur during pivoting of the grinding worm around a rotational axis C (FIG. 5). In this case, the correcting movements are based on:

$\Delta Y=f(\Delta C, X_{rel}, Y_{rel})$, $\Delta X=f(\Delta C, X_{rel}, Y_{rel})$.

The proposed profiling procedure can be performed with the device depicted in FIG. 5. The figure depicts a variant in which the profiling tool completes both the lift-and-advance movements and the pivoting movement. Comparable variants are possible in which the grinding worm completes the lift-and-advance movement and the pivoting movement, or in which various combinations of these movements are performed.

The device depicted in the figure has, on its workpiece side, a motorized spindle unit 15 which lies flat on the base plate 14 and onto which the grinding worm 16, which is rotatable around an axis B and is to be profiled, is mounted. The unit may pivot around a rotational axis C. The disk-shaped profiling tool 1, which pivots around an axis E, is fastened to a motorized spindle unit 17 positioned in parallel to the grinding worm spindle, and is advanced in the direction V along the rotating grinding worm 16 by means of a servo-driven lifting sled 18. Advance motion in the direction U is achieved at the lift end positions by means of an advance sled 19. To this end, the advance sled itself is adjustable on the base plate perpendicular to the axis of the workpiece. The lift sled 18 is located on the advance sled 19. The lifting movement of the profiling tool 1 and the rotational movement of the grinding worm 16 are coordinated with one another, via the control signals 20 and 21 and by means of a control unit 22, in such a way that the profiling tool completes a path defined by P1 * module * number of starts within a single revolution of the worm. To execute the proposed profiling procedure, a turntable 23 mounted on the lift sled 18 is used to pivot the spindle unit, with the profiling tool attached to it, around the axis F perpendicular to the profiling spindle and perpendicular to the advance movement. The pivoting movement and the correcting movements are completed by means of the control unit 22 and the control signals 20, 24, and 25, and are dependent on the stroke position of the profiling tool in relation to the grinding worm 16. To this end, the correcting movements in the direction of advance are superimposed on the advance movement by means of the sled 19, while the correcting movements in the direction of lift are superimposed on the lifting movement by means of the sled 18.

Once a spiral has been profiled by means of the procedure described above and in application of the device described above, its face pressure angle changes continuously along a section of the width of the grinding worm; this constitutes the actual modification of the spiral faces.

As described earlier, the position of the angle of rotation of the F-axis in relation to the profiling spindle unit or of the C-axis in relation to the grinding worm spindle unit is obtained by means of correcting calculations performed for a plurality of grinding worm width positions ($V_j$). The actual modification values that develop during profiling can be calculated by means of the coefficients of the correcting functions. The correcting calculation determines the extent to which these values deviate from the predetermined reference modification values. Thus, in order to obtain a variance matrix (residual errors across worm with and spiral depth), it is useful to calculate the actual modification values for the predetermined reference modification values by applying the correcting functions. To apply the described profiling procedure advantageously, all values in the calculated variance matrix must be smaller than a previously defined threshold value. If this is not the case, the proposed productive profile dressing (FIG. 1*a*) method used to generate the modification of the spiral face cannot be applied. In this case, the relative differences between the modification values for adjacent face points of a spiral axial section are so great that line contact between the spiral face and the profiling tool along the entire spiral depth does not produce the requisite modification quality.

The primary objective of an examination of the variance matrix is to determine whether the residual error values are inadmissibly high along the entire depth of the spiral or only along partial sections. If the residual errors along the entire spiral depth are excessively high, the second profiling procedure described below must be applied. As this procedure is based exclusively on line-by-line profiling of the spiral, it is very flexible with respect to the generation of modifications of the spiral faces. If, however, the residual errors are only too high in the crown and/or root sections of the spiral, a combination of the profile dressing and line-by-line profiling methods may be applied.

Figure 6A:
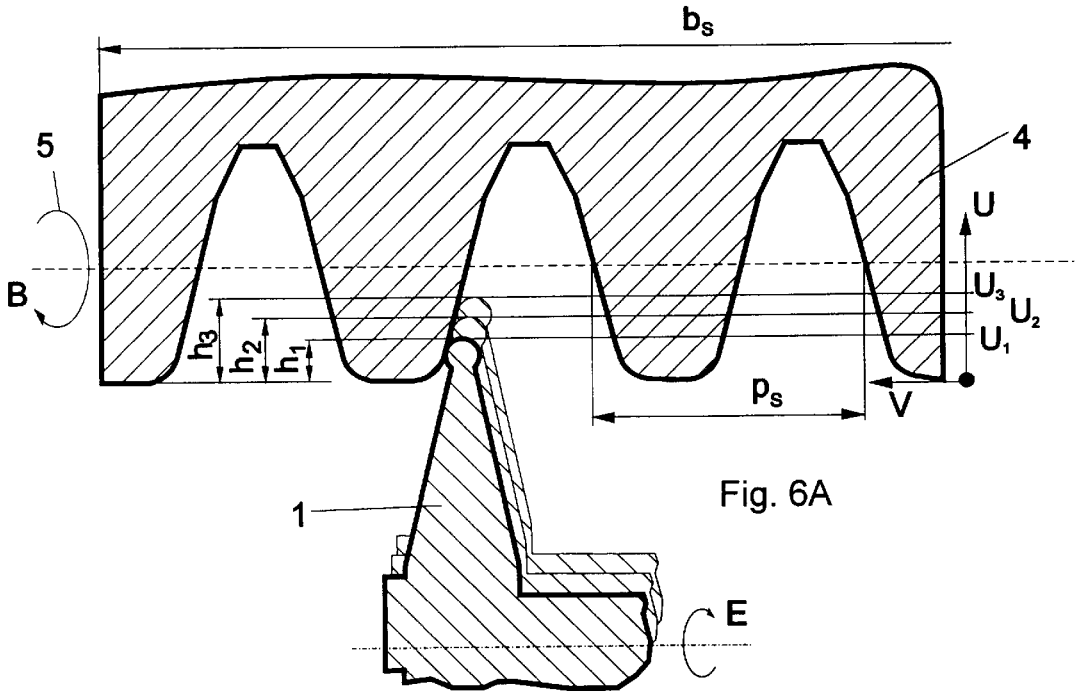
FIG. 6 shows a profiling method for generation of spiral face modifications by means of line-by-line profiling.
Figure 6B:
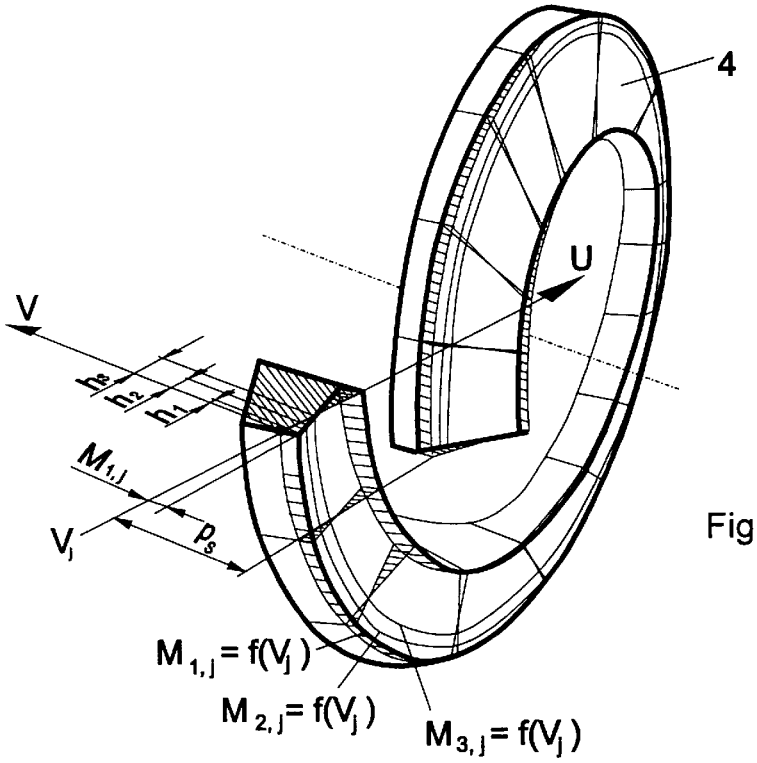

The starting point for the application of line-by-line profiling consists in the precise allocation of the tooth face coordinates to the contact points on the faces of the spiral, including the transformation calculation described earlier. In we make allowances for the line-by-line profiling of a spiral, the transformation calculation can be used to establish a relationship, for each profiling line (i) or for each spiral depth coordinate $U_i$, between the modification values $M_i$ of the spiral face and the worm width position $V_j$ (FIG. 6). This results in the following general relationship:

$M_{i,j}=f(U_i, V_j)$

If we now position a profile roll 1 at a defined spiral 4 depth ($h_1$ or $U_1$) and direct the profiling stroke movement across the worm width ($b_s$) as a function of both the basic incline ($p_s$) of the spiral 4 and the modification values ($M_{i,j}$) of this spiral depth ($h_1$), the desired modification of the profiling line will be generated at depth $h_1$. Thus, during line-by-line profiling of modifications, the link between the lifting movement of the profiling tool and the rotational movement 5 of the grinding worm is not only a factor of the basic incline of the grinding worm ($p_s$), but is also a factor of the modification values ($M_{i,j}$), which are obtained across the width of the worm for each profiling line by applying the transformation calculation.

If we apply this procedure to all profiling lines (i) needed for complete profiling along the depth (h) of the spiral 4, we can obtain a virtually point-by-point transfer of the modifications of the tooth faces to the corresponding contact points on the spiral faces. The overall incline in the spiral of the grinding worm section modified in this manner changes continually from one profiling line to the next, as well as along a single profiling line (across the width of the worm). As with the first proposed profiling method, the tooth face modifications are generated by diagonal hob grinding across the modified section of the grinding worm.

As mentioned earlier, tests have shown that line-by-line profiling along the entire spiral depth (h) is often not needed in order to maintain the requisite precision of modifications along the depth of the spiral. Thus, the change in modification values in the center section of the face (as viewed across the depth of the spiral) is often too minor to allow for profile dressing. In contrast, the modification values in the crown and root sections of the spiral are generally such that line-by-line profiling is necessary. Thus, another option for generating the predetermined reference profile of the spiral consists in a combination of the two profiling methods described above. The crown and root section of the spiral, which are generally characterized by a substantial change in modification values, are profiled through line-by-line profiling, as well as by continually changing the incline to generate the modifications. In contrast, the center section is profiled—while maintaining the requisite precision of the modifications—by means of the more productive profile dressing procedure, in which the pivoting movement discussed earlier is used to generate the spiral face modifications. In this manner, we reach a compromise between two objectives, the quality of the modifications and quantity during profiling.

Figure 7:
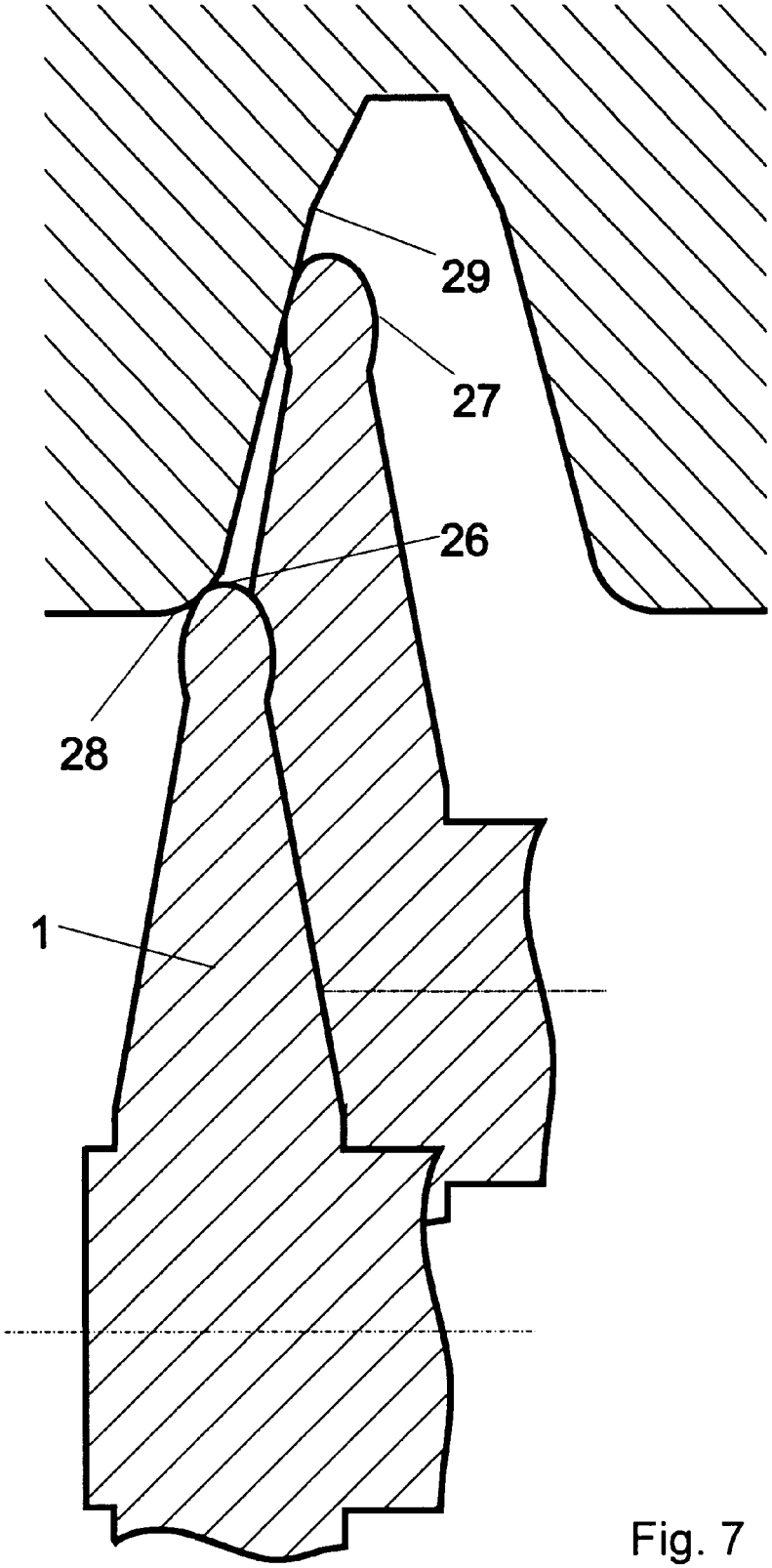
FIG. 7 shows a special profiling tool with two tool radiuses per face.

The use of the profiling tool depicted in FIG. 7 represents another way to reduce the substantial profiling times incurred when spiral face modifications are generated by means of line-by-line profiling and continual changes in the incline of the spiral. The tool comprises a crown radius 26 in its active section, as well as a flank radius 27 on both face sides adjacent to the crown radius. A special attribute of this profiling tool is that the flank radius 27 is much larger than the crown radius 26, preferably by a factor of at least 10. The use of this profiling tool is particularly appropriate in cases in which line-by-line profiling with a relatively large radius of the profiling tool 1 is permissible to generate the requisite spiral reference modifications, while at the same time spiral sections with substantial curvature, such as crown rounding radiuses 28 and profile reliefs 29, have to be profiled. The small crown radius 26 of the profiling tool depicted in FIG. 7 is used to complete profiling in spiral sections with substantial curvature. To ensure favorable positioning of the profiling tool, it may be necessary to pivot the profiling tool or the grinding worm by means of the axes of rotation (F or C) mentioned earlier. In contrast, the face sections of spirals with relatively minor curvature (due to modifications) are profiled using the flank radius 27 of the profiling tool. The advantage of using the large flank radius is that it allows for selection of a larger advance from one profiling line to the next, thus reducing profiling time without adversely affecting the form error of the profile line during hob grinding of the toothed wheel work.

In each of the profiling methods described above, the spiral face modifications being generated may extend across the entire width of the grinding worm ($b_s$) or only across a defined width section. However, the following procedure is advantageous in terms of optimal utilization of the entire width of the grinding worm.

The size of the section of the grinding worm requiring modification is mainly determined by the length of the contact lines 9 and 10 between the toothed wheel work and the grinding worm, as well as by shift advance 11 during diagonal hob grinding (FIGS. 2*a* and 2*b*). The size of the shift section is, in turn, primarily affected by the magnitude of the change in modification values in the axial direction of the grinding worm. The modifications in the axial direction of the worm are stretched at larger shift advance values and are compressed at smaller shift advance values. In this manner, it is possible to distribute the modification values along the face of the spiral, thus allowing for the targeted treatment of residual errors during profile dressing with a pivoting profile tool or a pivoting grinding worm. Furthermore, enlarging the modified worm section results in an increase in the number of workpieces that can be roll-ground in this section to the point of spiral wear, by means of the diagonal method, without sacrificing quality.

Conversely, it should be noted that the unmodified section of the grinding worm becomes smaller as the modified section of the grinding worm increases in size. However, this is necessary, as the modified grinding worm section is abraded rapidly when high time-cutting volumes are applied. Consequently, it is useful to divide the grinding worm into two areas or segments as described below.

Figure 8:
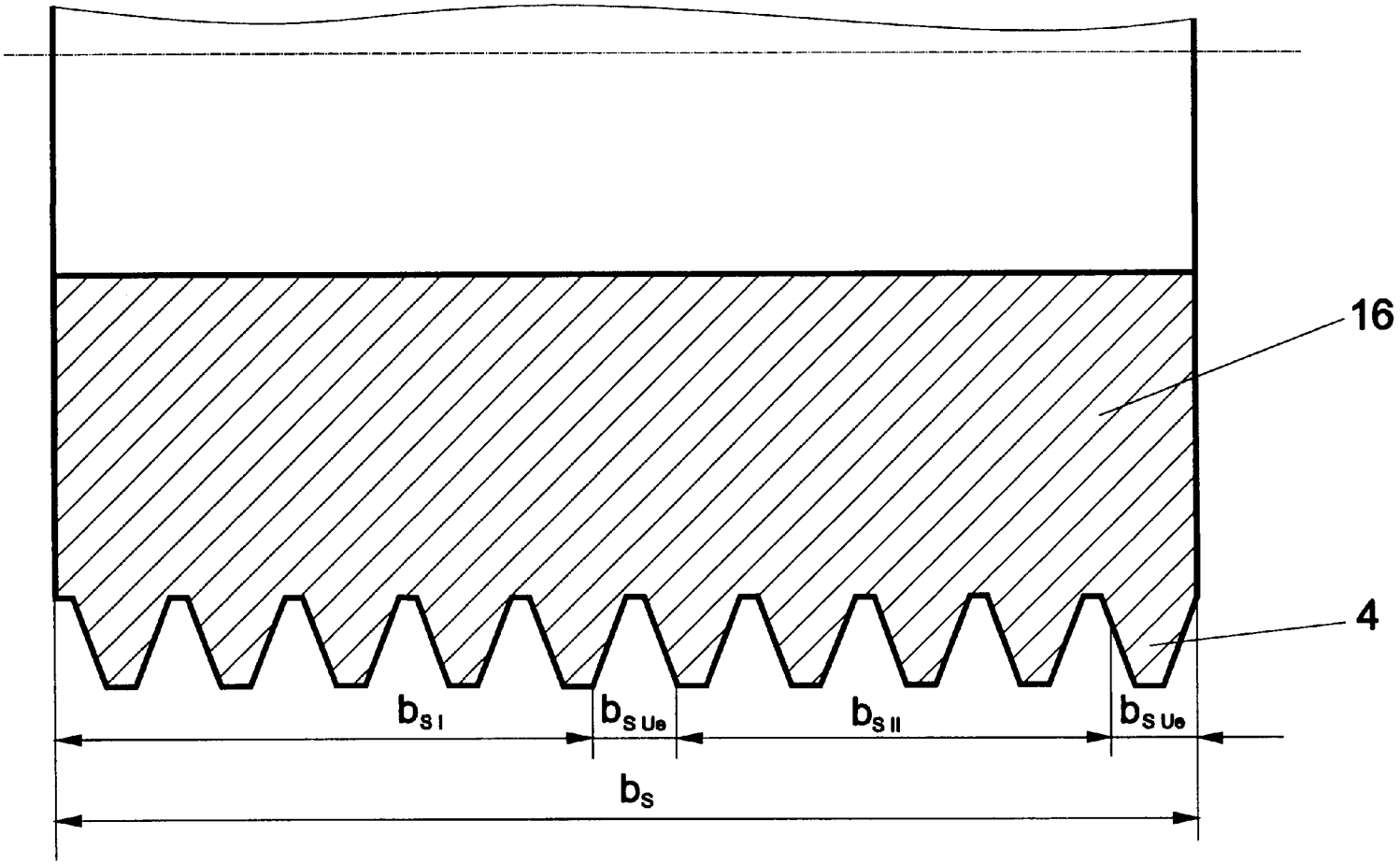
FIG. 8 shows a division of the grinding worm into various profiled sections.

Area I or segment I remains unmodified and is utilized when applying shift strategies conventionally used during continuous hob grinding. In contrast, area II or segment II receives the spiral face modifications needed to generate the tooth face modifications. This results in transitional sections ($b_{sue}$) between the modified and unmodified segments of the grinding worm, in which the individual machine axes needed to generate the modifications move either from the zero position toward the first required position of the modified segment or from the last position of the modified segment toward the zero position. In keeping with quality criteria, the width of both sections should be selected in such a way as to ensure that they become worn or consumed within about the same time of exposure. This results in the optimal division of the width of the grinding worm into modified and unmodified sections. For illustrative purposes, FIG. 8 depicts a grinding worm 16 which is divided along its width into an unmodified segment ($b_{si}$), a modified segment ($b_{su}$), and the transitional segments ($b_{sua}$) between these segments.

Another important attribute to mention in this context consists in the fact that, because of the tightly delineated contact range between the profiling tool and the spiral in relation to the depth of the spiral, the areas or segments may be interlaced during line-by-line profiling.

A separate transition between the unmodified and modified sections may be determined for each profiling line in relation to the position of the contact lines 9 and 10 (FIG. 2*a*). This allows for even more favorable utilization of the grinding tool.

What is claimed is:

1. A method for profiling a spiral of a cylindrical rotating grinding worm for diagonal hob grinding using a rotating disk-shaped profiling tool, comprising:

performing at least one of an advancing movement of the rotating disk-shaped profiling tool along the spiral of the rotating grinding worm and an advancing movement of the rotating grinding worm along the rotating disk-shaped profiling tool, engaging the disk-shaped profiling tool with the grinding worm over the entire depth of the spiral during a stroke in a direction of one of said advancing movement, and completing, within one segment of one of said advancing movement, an additional movement comprising a rotating movement of said disk-shaped profiling tool around a first axis of rotation (F) perpendicular to an axis of rotation (E) of said disk-shaped profiling tool, wherein the magnitude of the rotating movement completed during said one segment of one of said advancing movement depends on a position of the profiling tool relative to the spiral of the grinding worm, and, wherein said method for profiling forms faces of the spiral of the grinding worm having at least one of a pressure angle that diverges from a nominal pressure angle and a pressure angle that changes constantly along segments of the width of the grinding worm.

2. A method for profiling a spiral of a cylindrical rotating grinding worm for diagonal hob grinding using a rotating disk-shaped profiling tool, comprising:

performing at least one of an advancing movement of the rotating disk-shaped profiling tool along the spiral of the rotating grinding worm and an advancing movement of the rotating grinding worm along the rotating disk-shaped profiling tool, engaging the spiral of the grinding worm being profiled with the profiling tool along the entire depth of the spiral during a stroke in a direction of one of said advancing movement, and completing an additional movement of the grinding worm during the movement in one of said advancing direction, said additional movement consisting of a rotating movement of said grinding worm around a second axis (C) perpendicular to an axis of rotation (B) of said grinding worm, wherein the magnitude of the rotating movement completed during one of said advancing movement depends on a position of the profiling tool relative to the spiral of the grinding worm, and, wherein said method for profiling forms faces of the spiral of the grinding worm having at least one of a pressure angle that diverges from a nominal pressure angle and a pressure angle that changes constantly along segments of the width of the grinding worm.

3. A method in accordance with claims 1 or 2, further comprising:

applying a correcting function to reference modification values along the depth of the grinding worm spiral at a predetermined width position on the grinding worm, calculating a desired pressure angle diverging from the nominal pressure angle of a face of the spiral for said predetermined width position of the grinding worm, wherein a constant function is selected as an approximation for this correcting function.

4. A method in accordance with claims 1 or 2, further comprising:

performing correcting movements in a direction of at least one of said advancing movement and said direction transverse to one of said advancing movement, and superimposing the rotational movement of one of said disk-shaped profiling tool and said grinding worm on said correcting movements.

5. A method of profiling a spiral of a cylindrical grinding worm for diagonal hob grinding of gearwheels, the grinding worm having a width dimension, the method comprising the steps of:

rotating the grinding worm around a first axis;

rotating a disc-shaped profiling tool around a second axis;

moving the profiling tool relative to the grinding worm in a first direction perpendicular to the first axis into engagement with a spiral of the grinding worm over an entire depth of a tooth face of the spiral of the grinding worm;

moving the profiling tool relative to the grinding worm in a second direction parallel to the first axis so that the profiling tool crosses the entire width of the grinding worm;

synchronizing the movement in the second direction with a rotating angle of said grinding worm; and performing a rotational motion of the profiling tool relative to the grinding worm around a third axis which is perpendicular to the first direction and to one of said first and second axes in at least a sector of the movement in the second direction, said rotational motion being synchronized with the movement in the second direction such that a pressure angle of the tooth face of the grinding worm changes continuously within the sector.

* * * * *